US008678001B2

(12) United States Patent
Cowgill

(10) Patent No.: US 8,678,001 B2
(45) Date of Patent: Mar. 25, 2014

(54) WEARABLE REBREATHING APPARATUS

(75) Inventor: David E. Cowgill, Panama City Beach, FL (US)

(73) Assignee: BreatheAtor Vest Systems LLC, Panama City, FL (US)

( * ) Notice: Subject to any disclaimer, the term of this patent is extended or adjusted under 35 U.S.C. 154(b) by 371 days.

(21) Appl. No.: 12/807,021

(22) Filed: Aug. 27, 2010

(65) Prior Publication Data

US 2012/0048275 A1 Mar. 1, 2012

(51) Int. Cl.

| | |
|---|---|
| ***A62B 7/10*** | (2006.01) |
| ***A62B 23/02*** | (2006.01) |
| ***A62B 7/00*** | (2006.01) |
| ***A62B 9/00*** | (2006.01) |

(52) U.S. Cl.
USPC ..... 128/205.28; 128/205.17; 128/205.22

(58) Field of Classification Search
USPC ..... 128/205.28, 873, 874, 914, 200.24, 128/201.27, 201.29, 202.11, 202.19, 128/205.17, 205.12, 205.22, 205.27, 128/201.25; 405/185–187; 607/104
See application file for complete search history.

(56) References Cited

U.S. PATENT DOCUMENTS

| | | | | |
|---|---|---|---|---|
| 2,906,262 | A * | 9/1959 | Braunstein | 128/202.14 |
| 3,713,440 | A * | 1/1973 | Nicholes | 128/205.12 |
| 4,964,405 | A * | 10/1990 | Arnoth | 128/205.17 |
| 5,529,061 | A * | 6/1996 | Sanders | 128/205.22 |
| 6,302,106 | B1 * | 10/2001 | Lewis | 128/204.22 |

OTHER PUBLICATIONS

Calcium Hydroxide Mixture, Micropore, Inc., Apr. 19, 2002.
Lithium Hydroxide Curtains, ExtendAir, Micropore, Inc., on or before Dec. 31, 2007.
Micropore Extend Air CO2 Absorbent, year 2010 [online]. [retrieved on or before Aug. 26, 2010]. Retrieved from http://www.extendair.com/?id=tech.
The Selection, Installation, and Operation of a Modern Chemical Based Technology for the DISSUB CO2 Removal System in Royal Naval Submarines, Neil Scholes, UK Ministry of Defence, on or before Dec. 31, 2007.

* cited by examiner

*Primary Examiner* — Jackie Ho
*Assistant Examiner* — Ned T Heffner
(74) *Attorney, Agent, or Firm* — Hiscock & Barclay LLP

(57) ABSTRACT

A rebreathing apparatus has a clothing article wearable on a person. The clothing article defines a channel configured to be fluidly connected to at least one tube. The tube is configured to be fluidly connected to a mouthpiece. When the person exhales, the exhaled breath enters one end of the channel and passes through the channel while being scrubbed of $CO_2$. When the user inhales, the scrubbed air is drawn from the channel.

20 Claims, 10 Drawing Sheets

WEARABLE REBREATHING APPARATUS

BACKGROUND OF THE INVENTION

1. Field of the Invention

The present invention related to a closed circuit rebreather wherein the carbon dioxide ($CO_2$) scrubbing material is imbedded within a body worn vest in order to minimize the profile of the rebreather as well as to use the natural breathing rhythm of the user to assist in the function of the rebreather.

2. Background of the Prior Art

Rebreathers are used in a wide variety of applications including military settings, especially underwater teams that desire to remain stealth and not have air bubbles surface as would be the case if using open circuit breathing apparatus. Other applications include mine rescue or other industries where poisonous gas may be present or oxygen absent, manned space vehicles and space suits where a person is effectively in a vacuum, hospital anesthesia breathing systems that supply appropriately proportioned gas mixtures to a patient without letting the gas escape to be breathed by hospital personnel, submarines, and oxygen hyperbaric chambers, among other applications.

The rebreather works by recirculating exhaled air from the user's breath based on the fact that a person only absorbs about 25 percent of the available oxygen with each breath. The exhaled air passes through a scrubbing material, such as soda lime, wherein the carbon dioxide is removed. Additional oxygen and/or a diluent is added to the circuit either manually or via an electronic system that senses for the oxygen concentration using appropriate sensors such as oxygen sensitive electro-galvanic fuels cells that calculate the oxygen concentration in the breathing loop. The scrubbing material is held within a canister that is worn about the body of the person. The breathing air within the loop moves into and out of the canister through the small pressure changes generated through respiration by the user. While extremely useful, current rebreathers suffer from certain limitations. The large mounted scrubbing canister is cumbersome to wear and throws the overall weight distribution of the wearer far off from ideal. A land-based user finds such large canisters and the uneven weight distribution occasioned by the canisters to impede maneuverability and increase overall fatigue. Water-based users find that the canisters change the natural contours of the body so as to make the user less hydrodynamic via increased drag which decreases swimming speed and also increases fatigue. If the underwater user is scooter-based, the increased profile provided by current rebreathers increases overall drag which decreases scooter performance and decreases battery life. If a water-based user transitions to land, the uneven weight loading provided by the rebreather makes the transition awkward at best. Additionally, the diver is subject to hydrostatic loads due to the extra force required to breathe into a counter-lung above or exhale into a volume below the diver's chest.

What is needed is a rebreather that addresses the above-mentioned shortcoming in the art by providing a closed circuit rebreathing system that does not rely on a large carbon dioxide scrubbing canister that affects the natural contours of the user and that does not greatly alter the overall weight distribution load upon the wearer. Such a rebreather should allow the counter-lungs used by a rebreather to be essentially at chest level in order to permit the user to breath without the need to exert substantial additional breathing pressure. Ideally, such a rebreather will be of relatively simple design and construction and be easy to use and maintain.

SUMMARY OF THE INVENTION

The rebreather vest of the present invention addresses the aforementioned needs in the art by providing a closed circuit rebreathing system that, when donned, generally maintains the natural low profile contours of the wearer so as to allow the person to maintain a high level of hydrodynamics when under water so as to allow the person to be able to achieve essentially maximum velocity while swimming without undue fatigue or to minimize drag if using a scooter so as to maintain maximum performance of the scooter without shortening battery life to any great extent. The rebreather vest distributes the weight essentially evenly about the torso of the wearer so as to make the weight distribution more natural in order to allow the user to be more maneuverable on land as well as when transitioning from water to land. The rebreather vest provides its counter lungs at torso level so as to reduce the respiration pressures that must be maintained by the user so as to minimize fatigue. The rebreather vest is of relatively simple design and construction being made using standard manufacturing techniques. The rebreather vest is designed so that it can be stored in a partial vacuum until the device is needed so as to minimize size and storage requirements.

The rebreather vest of the present invention uses a counter-lung design that allows a flow path both above and below the arm of the wearer via the flow path of least resistance. The rebreather vest employs the use of a flexible carbon dioxide removal system deployed around the torso. The rebreather vest encapsulates a miniaturized high-pressure gas source within the counter-lung and may use the form of a single-use rebreather.

The rebreather vest of the present invention is comprised of a human-torso-wearing configured vest that has a first front portion and a second front portion joined by a back portion such that an internal air tight cavity exists within the vest. The cavity is divided into a series of passageways that form a single continuous channel that passes from the first front portion through the back portion and to the second front portion. The channel has a commencement point and a termination point. The cavity may be bounded by an inner layer and an outer layer. A first inlet port is located on the first front portion of the vest at the channel commencement point while an outlet port is located on the second front portion of the vest at the channel termination point. A tube has a first end connected to the first inlet port and an opposing second end attached to the outlet port and also has an opening disposed along its length. A first check valve is disposed within the tube between the opening and the first inlet port while a second check valve is disposed within the tube between the opening and the outlet port. A carbon dioxide scrubbing material is removably disposed throughout the length of the channel. A mouthpiece, such as a T-bit mouthpiece, may be located at the opening. A second inlet port is located on the vest such that a first canister having oxygen or diluent therein is fluid flow connected to the second inlet port. A control valve may be fluid flow connected with the first canister and the internal cavity while an oxygen sensor is disposed within the internal cavity and a processing module is provided for controlling the control valve based on at least one reading provided by the oxygen sensor. The first canister may be encapsulated within the second front portion and deliver its gas through a demand regulator system. A third inlet port may be located on the vest such that a second canister having oxygen or diluent therein is fluid flow connected to the third inlet port. An anti-collapse coil maybe disposed within the internal cavity. At least one over-pressure valve is attached to an outer surface of the vest and is in fluid flow communication with the internal cavity. Mounting studs may extend outwardly from the vest. A divider having a first surface and an opposing second surface may be disposed within the internal cavity between the inner layer and the outer layer such that a first portion of the channel is disposed between the first surface of the divider and the inner layer and a second portion of the channel disposed between the second surface of the divider and the outer layer. Neither the first portion of the channel nor the second portion of the channel is necessarily contiguous. A plurality of generally V-shaped resilient spacers may each be attached to either the inner layer or to the outer layer and face toward the divider. Alternately, a plurality of ribs is provided such that each rib is attached to the first surface of the divider and to the second surface of the divider. The scrubbing material may be disposed within the channel in a first layer and an overlapping second layer separated by a fibered filter material based spacer.

BRIEF DESCRIPTION OF THE DRAWINGS

Similar reference numerals refer to similar parts throughout the several views of the drawings.

DESCRIPTION OF THE PREFERRED EMBODIMENT

Figure 1A:
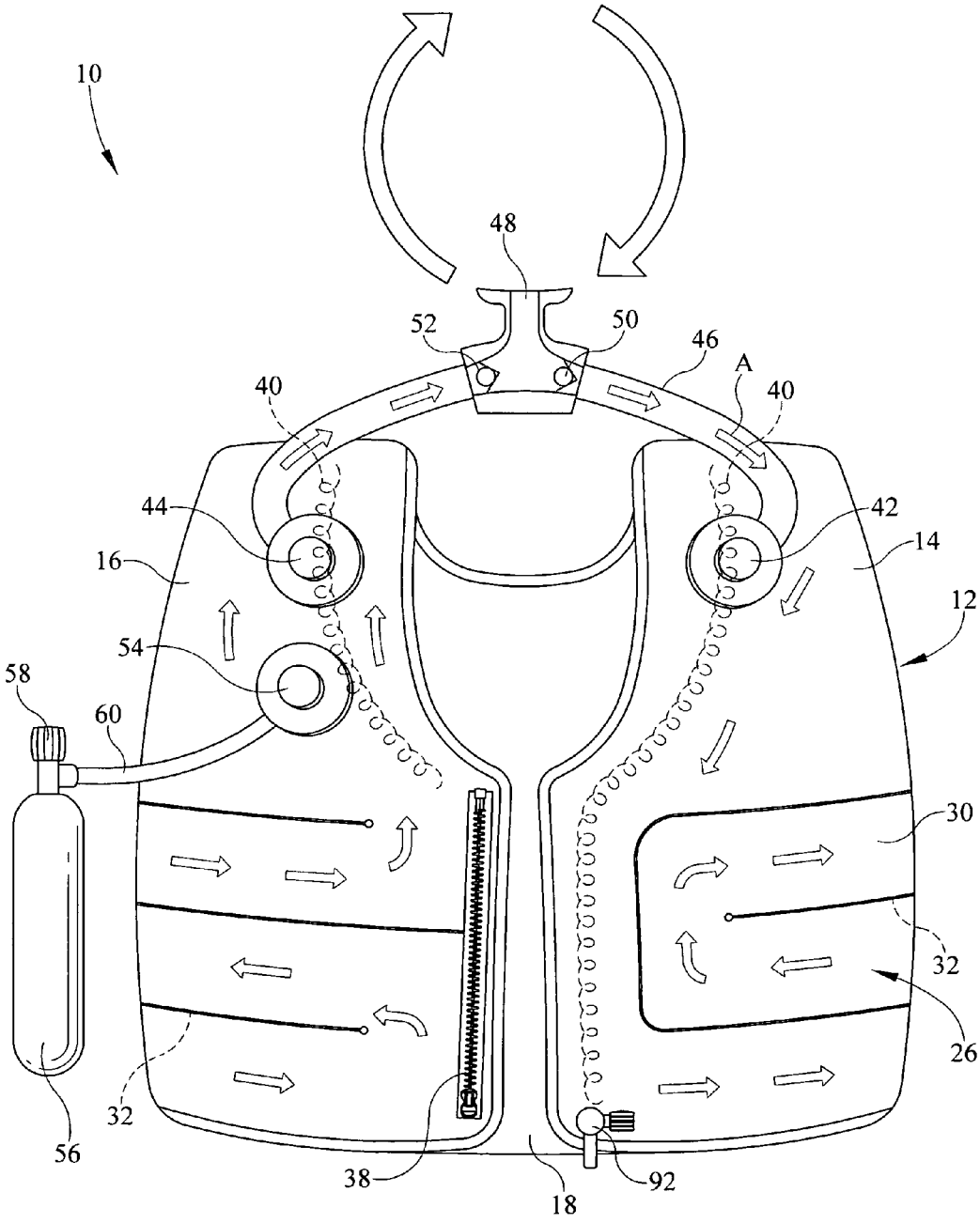
FIG. 1*a* is a front elevation view of the rebreather vest of the present invention in a single layer demand and/or constant flow gas injection configuration.
Figure 1B:
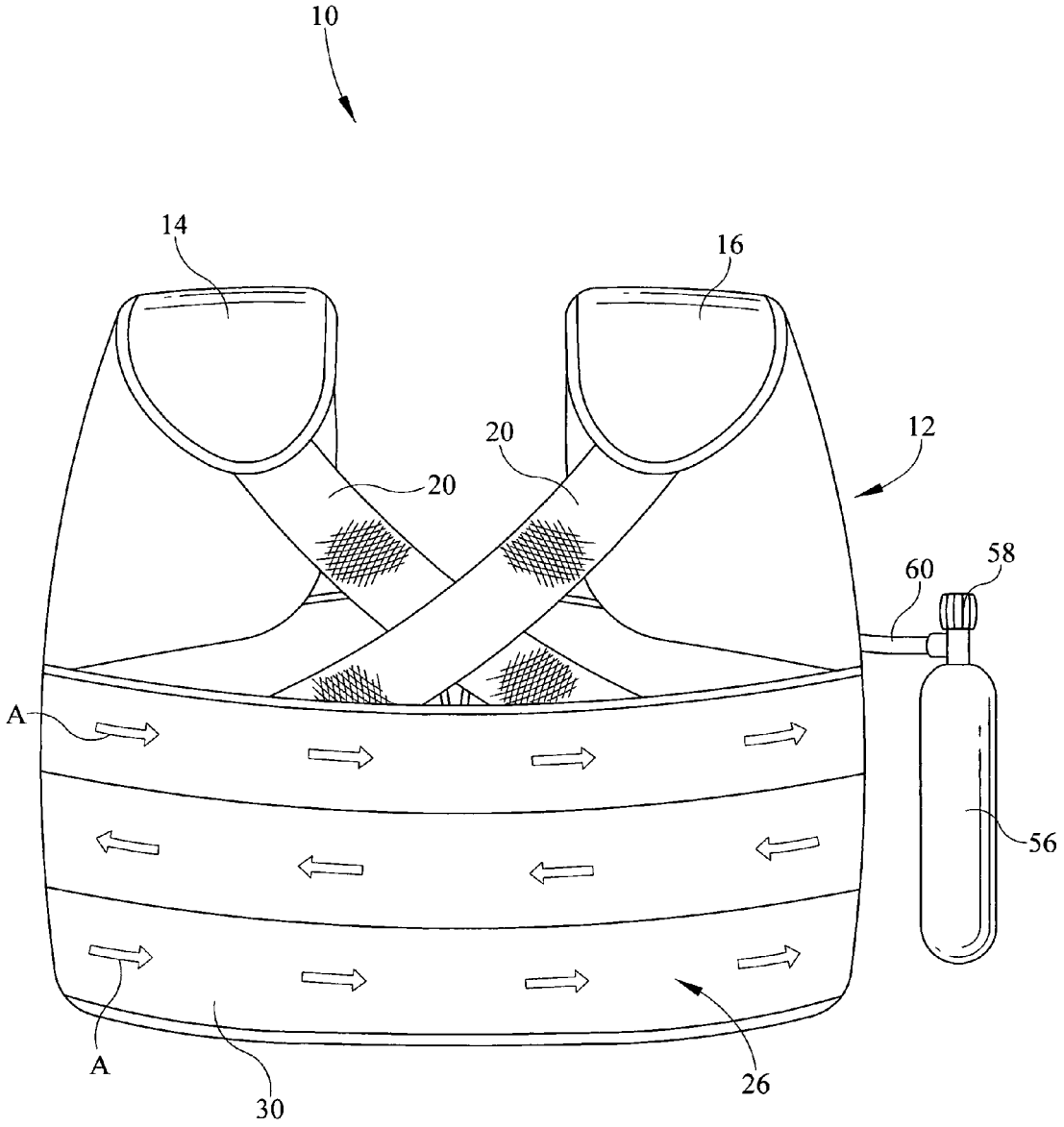
FIG. 1*b* is a back elevation view of the rebreather vest of FIG. 1*a*.

Referring now to the drawings, it is seen that the rebreather vest of the present invention, generally denoted by reference numeral 10, is comprised of a vest 12 of typical human torso configured vest configuration having a front left portion 14 that serves as a first counter-lung, a front right portion 16 that serves as a second counter-lung joined by a back portion 18. Webbing 20 may be used to join the back portion 18 with the ends of the front portions 14 and 16 or the back portion 18 may be full. Appropriate closure mechanisms (zipper, snap, latches, etc.,—none illustrated)—can be used to close the front of the vest 12 in the usual way.

Figure 4:
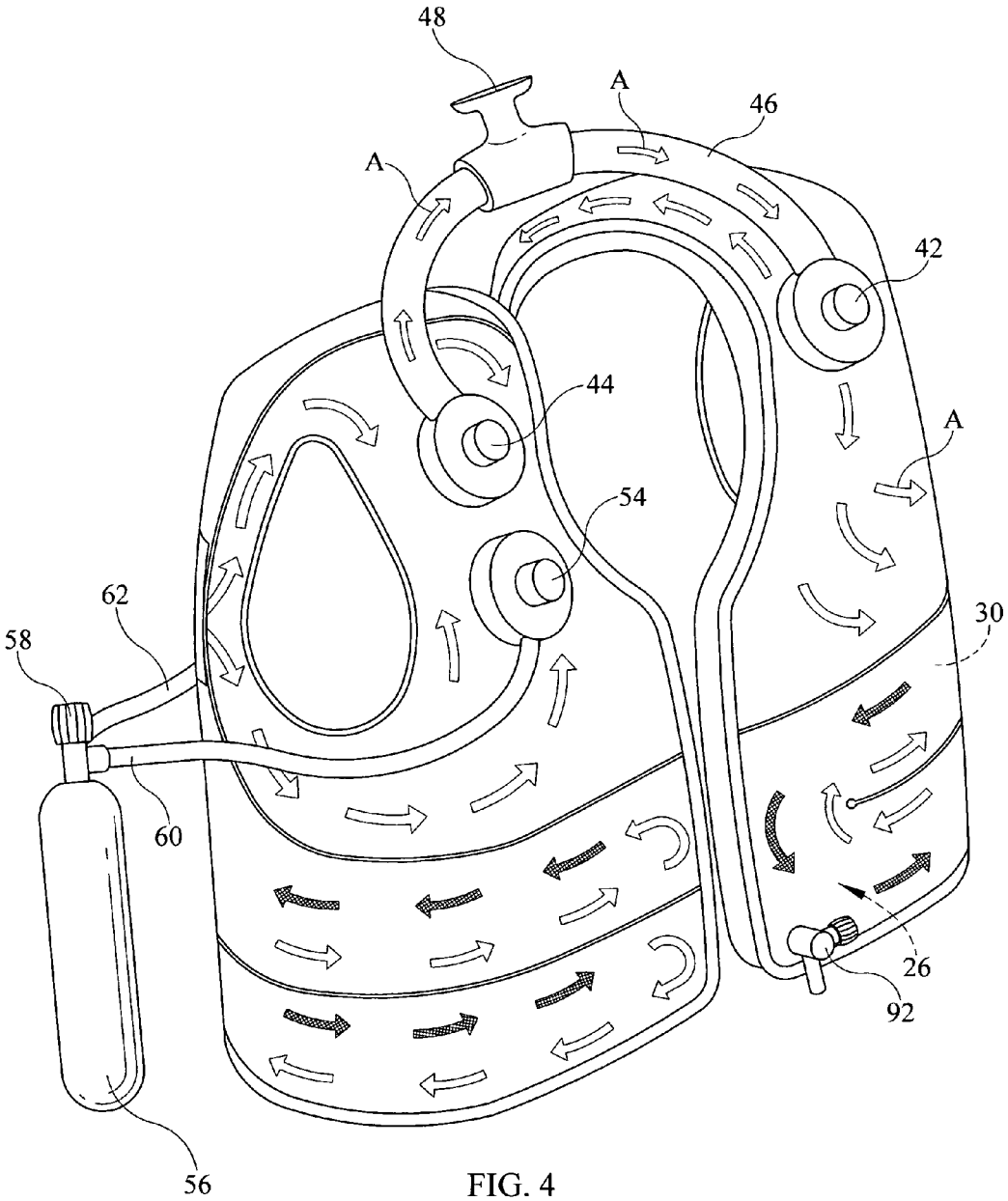
FIG. 4 is a perspective view of the rebreather vest of FIG. 2
Figure 5:
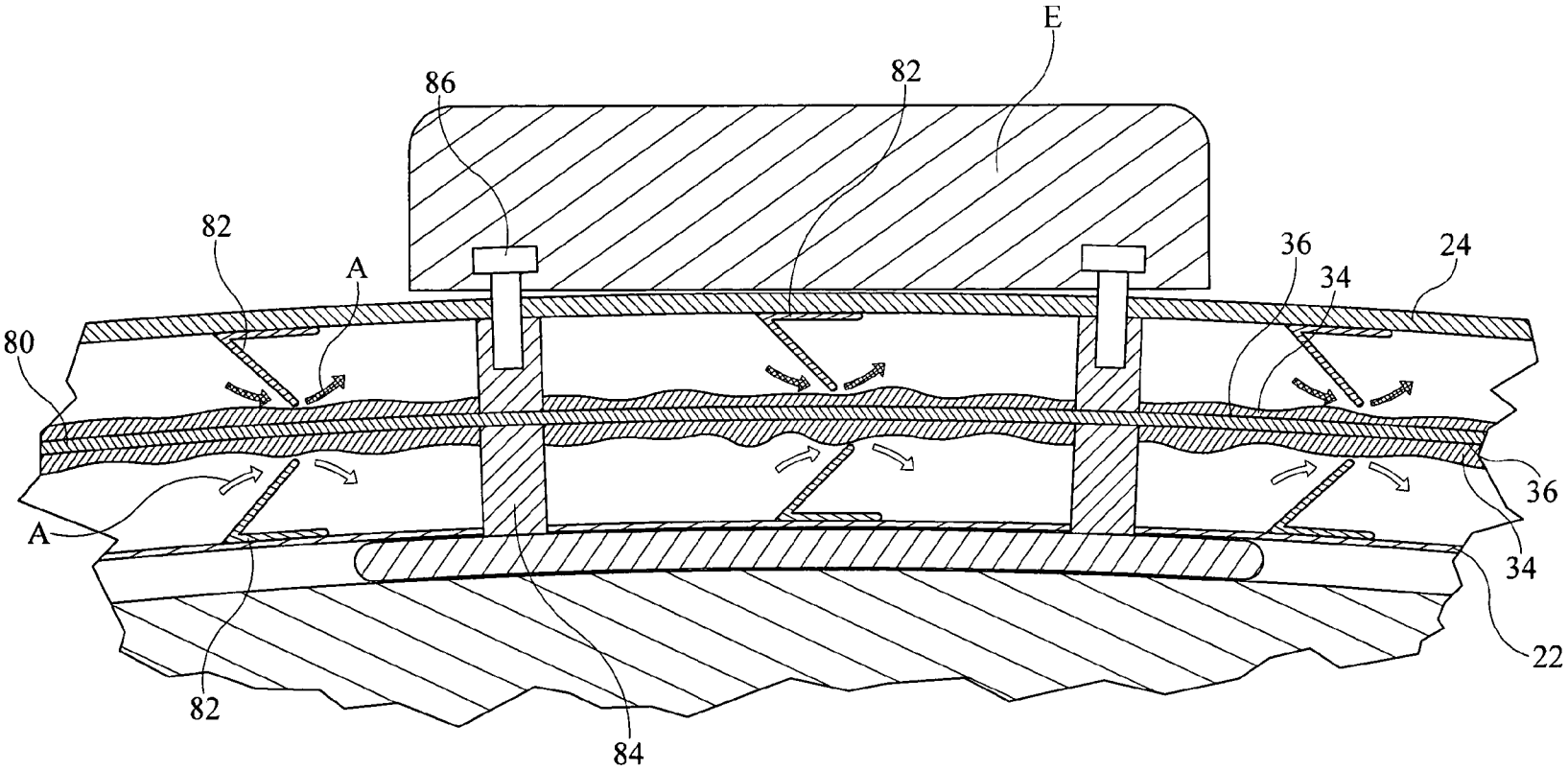
FIG. 5 is a partial cross-section view of the rebreather vest of FIG. 2.
Figure 6:
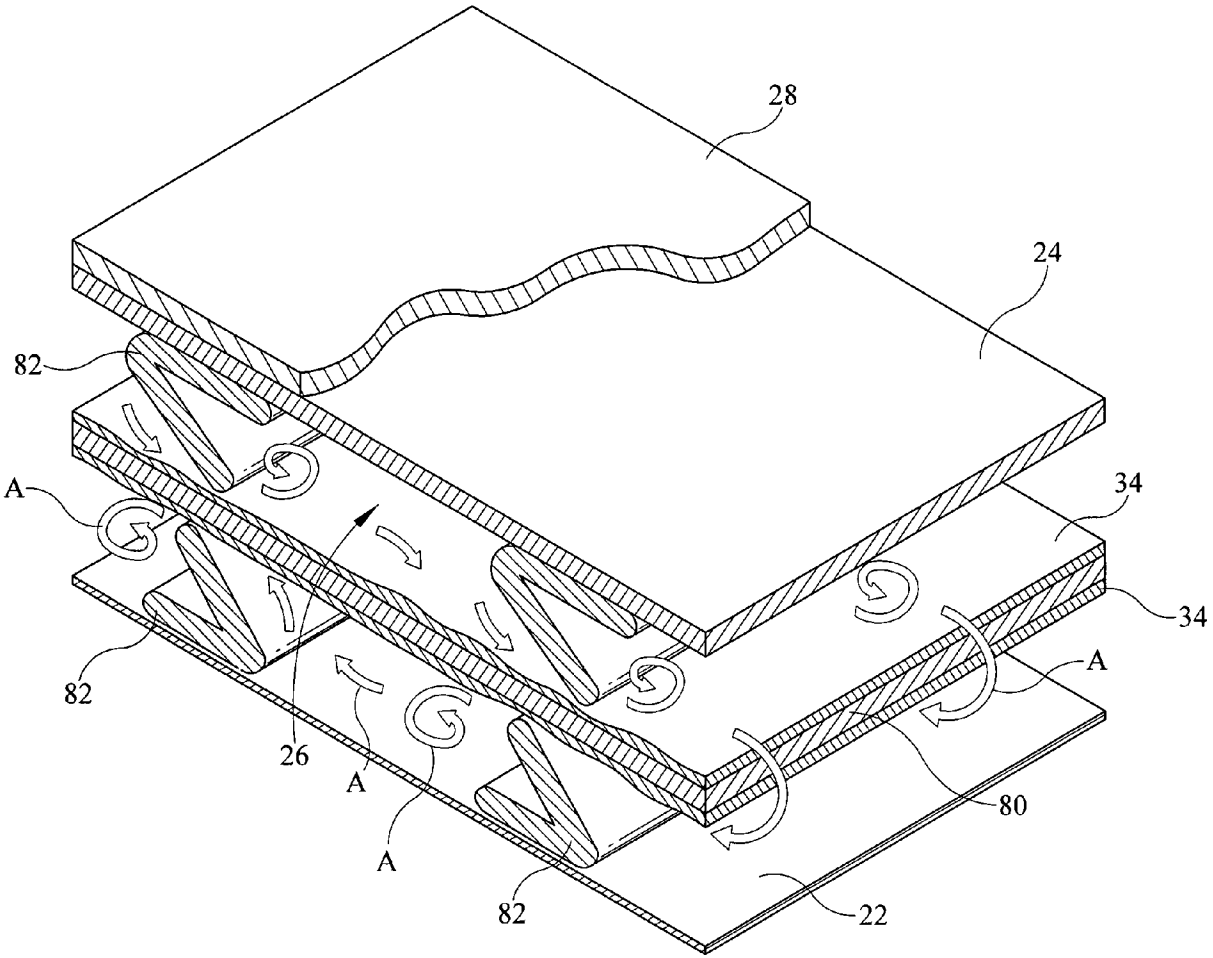
FIG. 6 is a perspective sectioned view of a portion of the internal channels within the rebreather vest of FIG. 2.

In the embodiment illustrated in FIG. 1*a*, the vest 10 has a first front closure edge, right closure edge or right closure segment extending substantially parallel to, and adjacent to, the zipper at opening 38. Likewise, the vest 10 has a second front closure edge, left closure edge or left closure segment shown, in FIG. 1*a*, opposite of such right closure segment. As illustrated in FIG. 1*a*, the vest 10 has a perimeter edge extending along the perimeter of the vest. The perimeter edge includes the right closure segment, left closure segment and bottom segment. The perimeter edge defines the neck receiving opening when the right closure segment is in contact with the left closure segment. The vest 10 has a right arm receiving edge which, in the embodiment illustrated in FIG. 4, is located to the right of the outlet port 44. The vest 10 has a left arm receiving edge which, in the embodiment illustrated in FIG. 4, is located to the left of the outlet port 42.

The vest 12 is formed from an inner layer 22 that contacts the user's body and an outer layer 24 joined together in order to provide an air tight internal cavity 26 within the vest 12. In the embodiment illustrated in FIG. 4, a plurality of seals join the layers 22 and 24 together. A first seal extends along the perimeter edge described above. A second seal extends along the right arm receiving edge described above. A third seal extends along the left arm receiving edge described above.

The inner layer 22 is made from an appropriate material for body contact which material allows for body hugging as well as stretching. Thin neoprene and Lycra are two suitable materials, although other candidates are also possible. The outer layer 24 may be the same as the inner layer and may have an additional layer 28 thereon that provides additional functionality to the vest 12 such as a ballistic material (KEVLAR etc.,) or may have pockets (not illustrated) into which appropriate body armor may be disposed. If a breathable material is used for either layer 22 and 24, an appropriate layer will be added in order to achieve the air tight internal cavity 26. The internal cavity 26 is segregated into a series of passages 30 by a series of walls 32, made from an appropriate sturdy material such as flexible plastic that is attached to the inner layer 22 and the outer layer 24. The passages 30 form a single overall continuous channel Removably attached to the inner layer 22 or outer layer 24 or both layers 22 and 24 is an appropriate carbon dioxide scrubbing material 34 such as soda lime, etc. The scrubbing material 34 is to be disposed on a separate backing material 36 (a so-called scrubbing material belt) so as to allow the scrubbing material 34 to be able to be quickly and easily removed and replaced when fully spent. An opening 38, such as the illustrated zipper (other candidates include cooperating hook and loop material, snaps, etc.,) is provided in order to have service access to the internal cavity 26—the opening 38 can be located at any appropriate location about the vest 12. An appropriate seal (not illustrated) is located beyond the opening 38 in order to maintain the air tightness of the internal cavity 26. Also disposed within the internal cavity 26 is a pair of oxygen compatible anti-collapse coils 40 that help maintain the internal cavity 26 in an "open" configuration when the device 10 is being used.

As seen a first or inlet port 42 is attached to the left portion 14 of the vest 12 and air flow communicates with the channel 30, the channel 30 having its commencement point hereat. A second or outlet port 44 is attached to the right portion 16 of the vest 12 and air flow communicates with the channel 30, the channel 30 having its termination point hereat. A tube 46 has a first end attached to the inlet port 42 and a second end attached to the outlet port 44. A mouthpiece 48, such as the illustrated T-bit mouthpiece is disposed centrally along the length of the tube 46. It is expressly recognized that a face shield or a full head mask can be used in lieu of or in addition to the mouthpiece 48 depending on the specific application desired for the rebreather 10 as is well understood in the art. A first check valve 50 is located within the tube 46 between the mouthpiece 48 and the inlet port 42 while a second check valve 52 is located within the tube 46 between the mouthpiece 48 and the outlet port 44. A second inlet port 54 is provided and is fluid flow connected to a first canister 56 having a first valve 58 thereon, via a first air hose 60, the first canister 56 having oxygen or diluent therein.

Figure 2:
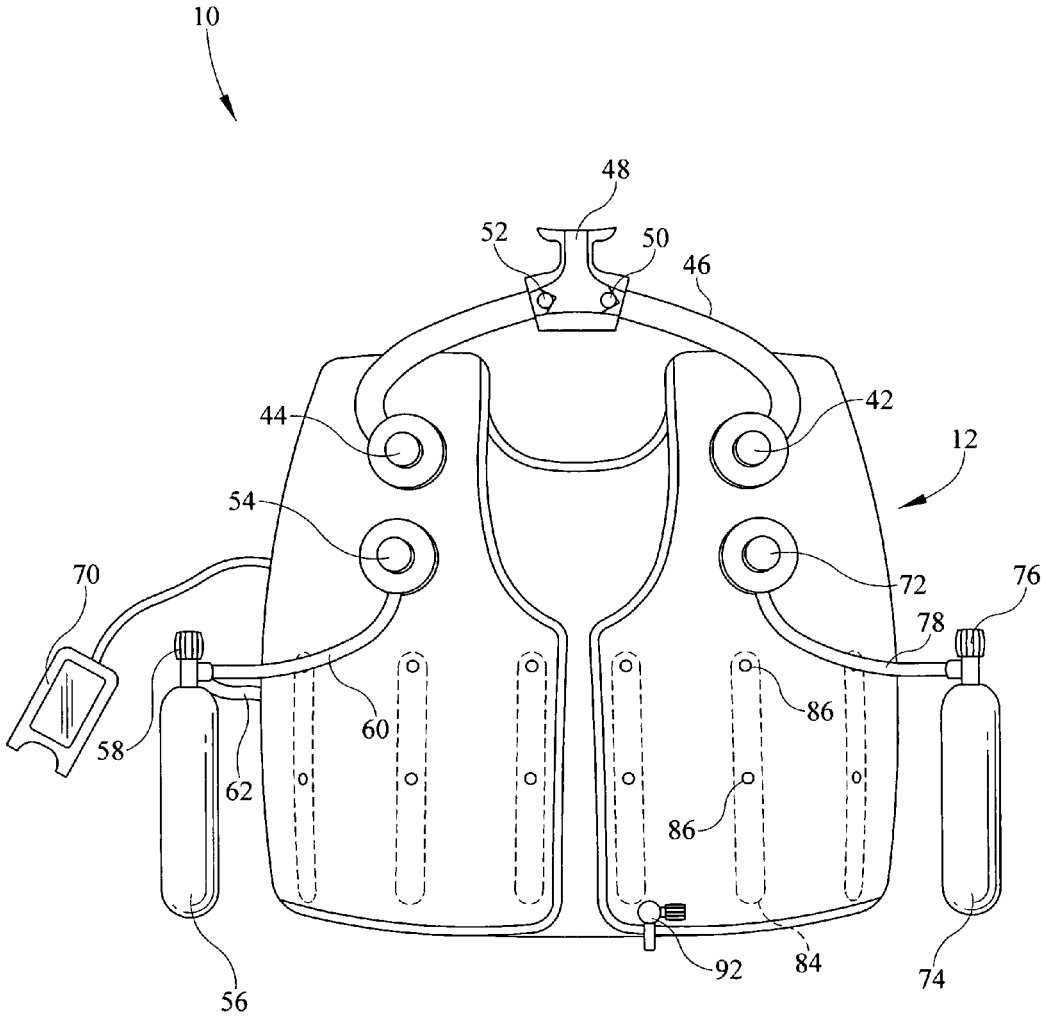
FIG. 2 is a front elevation view of the rebreather vest in a double layer demand and electronic control gas injection configuration.
Figure 3:
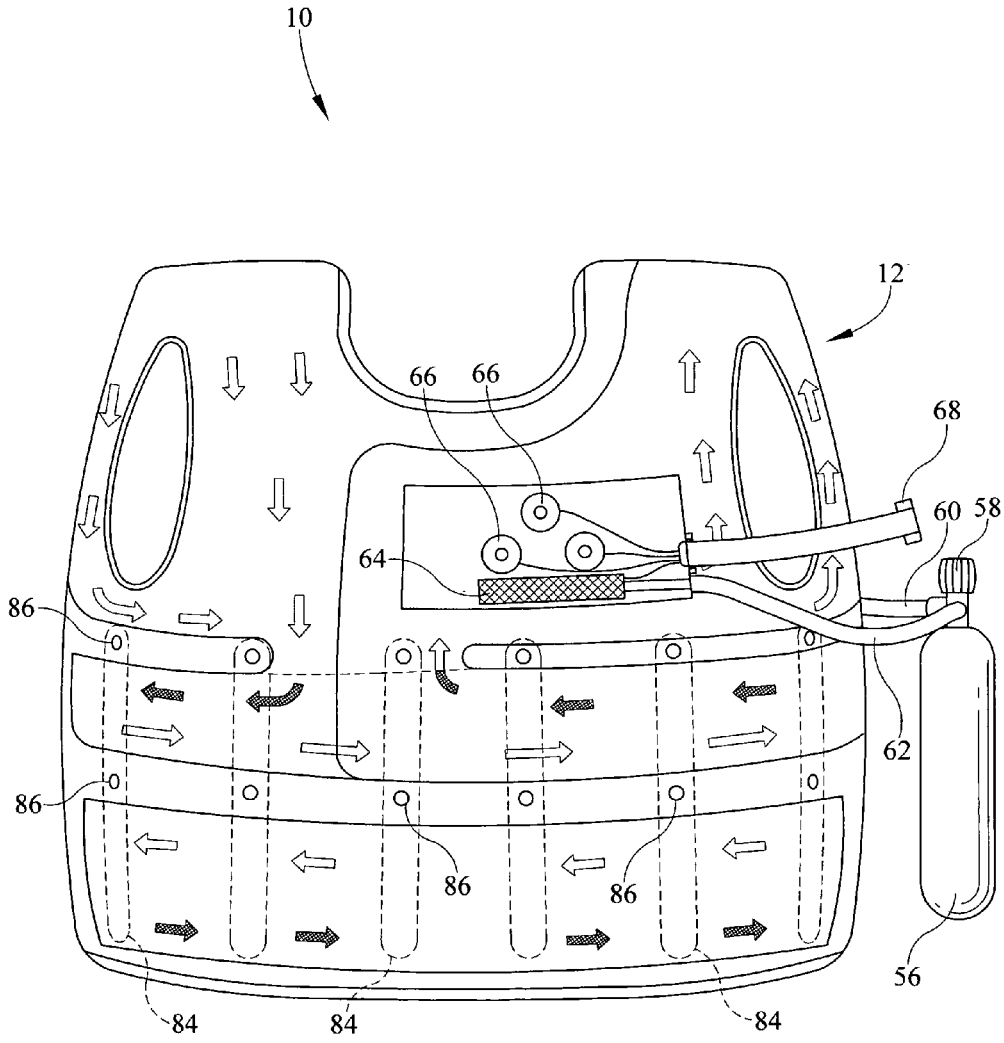
FIG. 3 is a back elevation of the rebreather vest of FIG. 2.

As best seen in FIGS. 2-4, the first canister 56 may also be connected via a second air hose 62 to a control valve 64, advantageously located on the back portion 18, the control valve 64 fluid flow connecting the second hose 62 with the internal cavity 26. One or more oxygen sensors 66 are located on the back portion 18 within a pocket of the vest 12 and sense oxygen levels within the channel 30. The oxygen sensors 66 are electronically connected to a processing module 68 which module 68 is also connected to the control valve 64 for controlling operation of the control valve 64 based on the readings of the sensors 66. An appropriate display device 70 is connected to the processing module 68 in order to allow the user to monitor the status of the processing module 68. As also seen, a third inlet port 72 may be provided and be fluid flow connected to a second canister 74 having a second valve 76 thereon, via a third air hose 78, the second canister 74 having oxygen or diluent therein. In a two canister configuration, typically the first canister 56 has oxygen therein while the second canister 74 has diluent therein As seen, the internal cavity 26 may be separated into two sections via a semi-rigid (sufficiently rigid to hold its shape, yet sufficiently flexible for vest 12 donning and doffing) divider 80 that extends essentially throughout the internal cavity 26 so that one section of the internal cavity 26 is located between the divider 80 and the inner layer 22 of the vest 12 and the other section is located between the divider 80 and the outer layer 24 of the vest 12. The scrubbing material 34 is disposed on both sides of the divider 80. In this configuration, the channel 30 is still a single continuous channel with its commencement point at the first inlet port 42 and its termination point at the outlet port 44, but now passes through both sections of the internal cavity 26. In this configuration, the air A passes across substantially more scrubbing material 34 allowing for longer dwell times with the scrubbing material 34 allowing more effective scrubbing of the air A as well as a longer life span between scrubbing material 34 change out.

In this dual section configuration, the vest 12 is maintained in the "open" position by a series of separators 82 that are attached to the inner layer 22 of the vest 12 as well as the outer layer 24 of the vest 12. The separators 82 are made from an appropriate resilient material such as a flexible non-reactive plastic. When the device 10 is not being used, the vest 12 may be held flat, that is the outer layer 24 and the inner layer 22 are pressed tight together which causes the separators 82 to flatten out thereby maintaining the vest 12 is a very flat and compact configuration that is easily stored and transported. The vest 12 may be held in this very flat configuration via an appropriate mechanical means or may be stored under at least partial vacuum to so maintain the vest 12. When the vest 12 is ready for use, either release of the vest 12 from its mechanical or vacuum hold allows the separators 82 to resiliently spring back to their original V-shape or introduction of air A into the internal cavity 26 achieves the result, thereby filling the vest 12 out. In this configuration, the separators 82 act as valves or flow restrictors for the air A passing thereby. This creates turbulence within the channel 30 which increases the interaction time between the air A and the scrubber material 34 so as to achieve greater efficiency in air scrubbing.

As also seen, a series of mounting ribs 84 may be provided and have mounting studs 86 thereon to hold auxiliary equipment E as desired.

Figure 7:
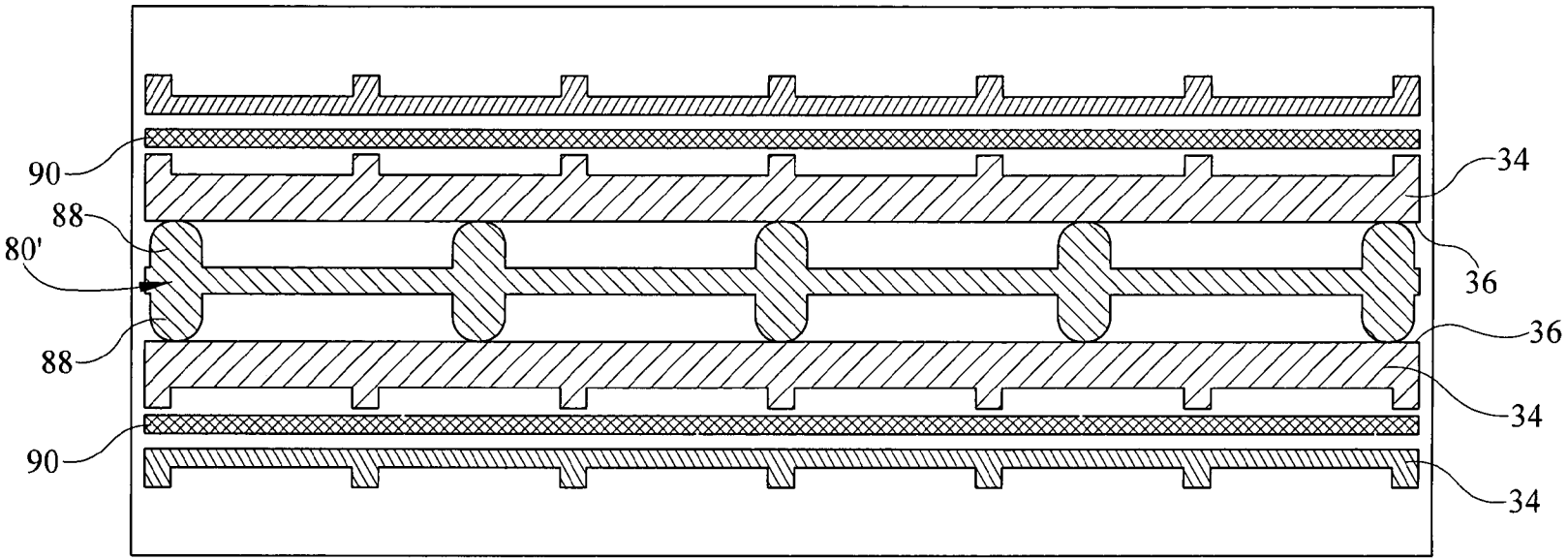
FIG. 7 is an end view of the rebreather vest of FIG. 5.
Figure 8:
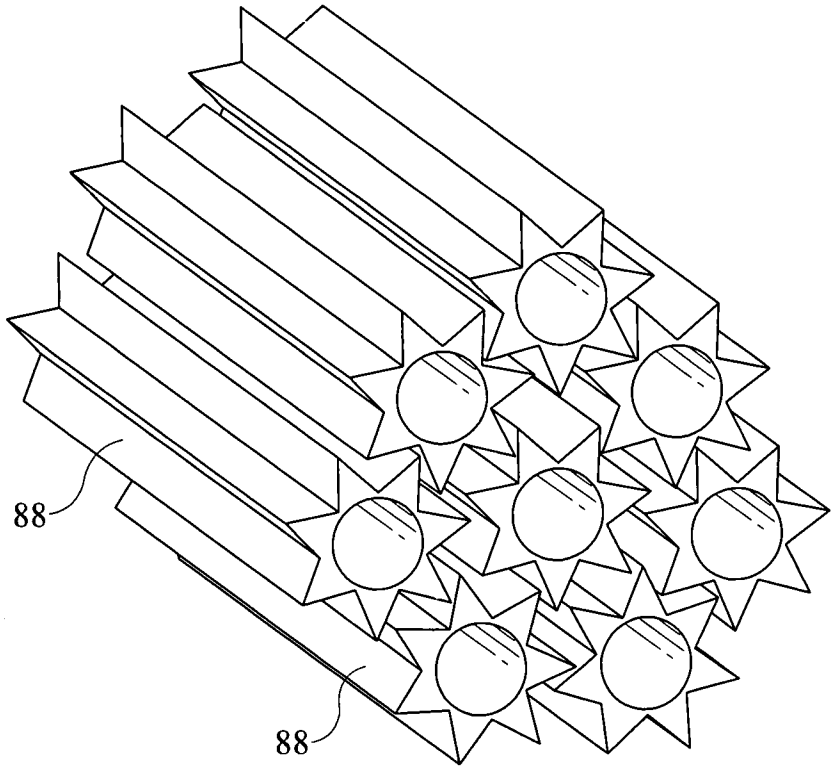
FIGS. 8 and 9 are perspective views of other shapes possible for extruded carbon-dioxide absorbent material for use within the internal cavity of the rebreather vest.
Figure 9:
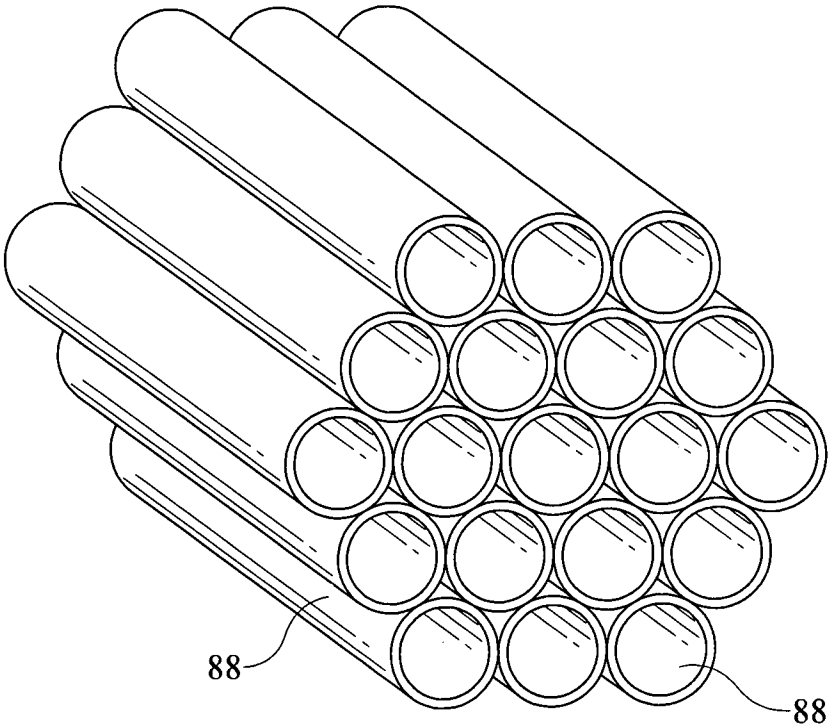

As seen in FIGS. 7-9, an alternate method of separating the layers of the internal cavity 26 uses a divider 80' that has a series of spacer ribs 88 of any appropriate configuration (see FIGS. 8 and 9) on either side, either formed as part of the divider 80' or attached thereto. In this configuration, once a belt of scrubber material 34 is attached to or positioned upon the spacer ribs 88, a spacer 90 may be placed on the scrubber material 34, such spacer 90 being a fiber air filter type of material, with a second belt of scrubber material 34 placed onto the spacer 90 in order to further increase the amount of scrubber material 34 within the internal cavity 26.

If water should enter the internal cavity 26 in any fashion, then either a desiccant (not illustrated) can be disposed within the internal; cavity 26 or one or more dump/over-pressure valves 92 can be located on the vest 12 at substantially the lowest point on the vest 12 in order to dispel any water entrained within the internal cavity 26.

In order to use the rebreather vest 10 of the present invention, the channel 30 is populated with the scrubbing material 34 while a fresh first canister 56 is attached to the first hose 60 and second hose 62 if so configured, and a fresh second canister 74 is attached to the third hose 78. The user dons the vest 12 is the typical way and places the mouthpiece 48 into his or her mouth. The user breathes in normal fashion in the same manner as with other rebreathers. As the person exhales, the exhaled air A is passed through the mouthpiece 48 and enters the inlet port 42 via the tube 46, the second check valve 52 preventing the air A from flowing toward the outlet port 44. The air enters the channel 30 within the vest 12 and travels the length of the channel 30 through the front left portion 14, through the back portion 18, and into the front right portion 16. While within the channel 30, the air A is scrubbed via the scrubbing material 34 in the usual way. Once the air A has reached the end of the channel 30, the air A enters the tube 46, scrubbed of carbon dioxide, via the outlet port 44 and is breathed in by the user. During breath intake in, the user cannot draw air A from the inlet port 42 due to the first check valve 50. By having the relatively heavy scrubbing material 34 distributed about the vest 12, both front and back, the overall weight distribution of the rebreather 10 for the wearer is relatively well distributed and helps the user maintain balance as humans work exceedingly well whenever a load is essentially evenly placed on the user's torso. Additionally, both counter-lungs are at torso level making breathing more natural and less labored so as to reduce user fatigue during device 10 usage. Variations employ constant flow oxygen or gas mixture injection as in a semi-closed set plus conventional demand regulator gas delivery during high work output. The constant flow plus demand regulation system allows for positive pressure masks on the wearer. Land based use in contaminated atmospheres is greatly enhanced by this feature. When needed, oxygen, either pure or via a diluent, can be manually replenished into the channel 30 via the first canister 56 simply by opening the valve 58 thereon and letting the oxygen or diluent flow into the channel 30 via the second inlet port 54 or via the second canister 74 by opening the second valve 76 and letting the oxygen or diluent flow into the channel via the third inlet port 72. Alternately, if the rebreather 10 is electronically equipped, then oxygen or diluent is introduced into the channel 30 automatically via the control valve 62 via the readings of the oxygen sensors 66 and under the control of the processing module 68. Of course the automatic replenishment system can be manually overridden if the user so desires. When the scrubbing material 34 is fully spent, the material 34 is removed and replenished via the opening 38 provided.

While the invention has been particularly shown and described with reference to embodiments thereof, it will be appreciated by those skilled in the art that various changes in form and detail may be made without departing from the spirit and scope of the invention.

I claim:

1. A rebreathing apparatus comprising:

a human-torso-wearing configured vest having a front and a back, the front including a first front portion having a first front closure edge and a second front portion having a second front closure edge, the back including a back portion, the vest defining an internal cavity, the cavity being divided into a series of passageways that form a single continuous channel that passes through the first front portion, the second front portion and the back portion, the channel having a commencement point and a termination point, the channel configured to be in fluid communication with at least one container of gas;

an inlet port located on the first front portion of the vest at the commencement point;

an outlet port located on the second front portion of the vest at the termination point;

a carbon dioxide scrubbing material disposed within the channel, a first part of the carbon dioxide scrubbing material being located in the first front portion adjacent to the first front closure edge, a second part of the carbon dioxide scrubbing material being located in the second front portion adjacent to the second front closure edge, a third part of the carbon dioxide scrubbing material being located in the back portion of the vest;

a mouthpiece configured to receive breath exhaled from a wearer;

at least one tube fluidly connected to the mouthpiece, the at least one tube being in fluid communication with the inlet port and the outlet port;

a first valve positioned within the at least one tube, the first valve being configured to direct the breath toward the inlet port; and a second valve positioned within the at least one tube, the second valve being configured to direct at least part of the gas and at least part of the breath toward the mouthpiece after the part of the breath has flowed past the carbon dioxide scrubbing material.

2. The rebreathing apparatus as in claim 1, wherein the at least one tube has a plurality of ends, each of the ends defining an opening, the tube defining an additional opening located between the ends, one of the ends being connected to the inlet port, another one of the ends being connected to the outlet port, the tube being connected to the mouthpiece, the mouthpiece being located adjacent to the additional opening.

3. The rebreathing apparatus as in claim 1 further comprising: a second inlet port located on the vest; and the at least one container of gas, the at least one container being fluid flow connected to a portion selected from the group consisting of the first front portion and the second from portion.

4. The rebreathing apparatus as in claim 3 further comprising:

a control valve fluid flow connected with the at least one container and with the internal cavity;

at least one oxygen sensor disposed within the internal cavity; and at least one processing module for controlling the control valve based on at least one reading provided by the oxygen sensor.

5. The rebreathing apparatus as claim 4, wherein the wearer has a chest and a backside, the vest being configured so that, when the vest is worn by the wearer: (a) the first front portion and the second front portion are positionable adjacent to the chest; and (b) the back portion is positionable adjacent to the wearer's backside.

6. The rebreathing apparatus as claim 1, wherein the wearer has a torso, the wearer's torso having a front, a backside, and a plurality of sides, the vest being configurable into a cylindrical form, the cylindrical form having: (a) the first front portion positionable over at least part of the front of the torso; (b) the back portion positionable over at least part of the backside of the torso; and (c) a plurality of side portions, each one of the side portions being positionable over one of the sides of the torso, the carbon dioxide scrubbing material being disposed throughout the cylindrical form, including the first front portion, the back portion and the side portions.

7. The rebreather apparatus as in claim 1 further comprising an anti-collapse coil disposed within the internal cavity.

8. The rebreather as in claim 1 further comprising an overpressure valve attached to an outer surface of the vest and in fluid flow communication with the internal cavity.

9. The rebreather as in claim 1, wherein: (a) the first front portion defines a first reservoir free of internal obstructions, the first reservoir configured to hold a volume of breath received from the wearer; and (b) the second front portion defines a second reservoir free of internal obstructions, the second reservoir configured to hold a volume of at least part of the gas and at least part of the breath after the part of the breath has flowed past the carbon dioxide scrubbing material, the first and second front portions being positionable adjacent to a chest of the wearer when the wearer is wearing the vest.

10. The rebreather as in claim 1, wherein the vest includes:

(a) an inner layer and an outer layer which define the internal cavity; and (b) a divider having a first surface and an opposing second surface disposed within the internal cavity between the inner layer and the outer layer such that a first portion of the channel is disposed between the first surface of the divider and the inner layer and a second portion of the channel disposed between the second surface of the divider and the outer layer.

11. The rebreather as in claim 10 further comprising a plurality of generally V-shaped resilient spacers each attached to either the inner layer or to the outer layer and facing toward the divider.

12. The rebreather as in claim 1, further comprising at least one mount attached to the vest.

13. The rebreather as in claim 12 wherein the scrubbing material is disposed within the channel in a first layer and an overlapping second layer separated by a fibered filter material based spacer.

14. A rebreathing apparatus comprising:

a multilayer clothing article wearable on an upper body of a person, the person'supper body having a front, a plurality of sides and a back, the multilayer clothing article having:

(A) an inner layer spaced apart from an opposing layer, the inner layer configured to contact the person's upper body, the opposing layer being positioned opposite of the inner layer, the inner and opposing layers defining a breathing channel, the breathing channel configured to be in fluid communication with at least one container of gas;

(B) a perimeter edge extending along a perimeter of the multilayer clothing article, the perimeter edge including a right closure segment and a left closure segment, the perimeter edge defining a neck receiving opening when the right closure segment is in contact with the left closure segment;

(C) a plurality of arm receiving edges, including a right arm receiving edge and a left arm receiving edge, each one of the arm receiving edges defining an arm receiving opening configured to receive an arm of the person;

(D) a plurality of upper sections, including: (a) a right upper section positioned between part of the right arm receiving edge and the right closure segment; and (b) a left upper section positioned between part of the left arm receiving edge and the left closure segment;

(E) a lower section located below the upper sections, the lower section extending between the right and left closure edges, the lower section being positionable over the person's front, sides and back when the right closure segment is in contact with the left closure segment while the person is wearing the multilayer clothing article;

(F) a plurality of seals which seal the inner layer to the opposing layer, the seals including: (a) a first seal extending along the perimeter edge; (b) a second seal extending along the right arm receiving edge; (c) a third seal extending along the left arm receiving edge; and (d) a plurality of additional seals defining a plurality of internal seal lines, the internal seal lines defining a plurality of segments of the breathing channel, the segments including:

(i) a first channel segment within one of the upper sections, the first channel segment defining an inlet;

(ii) a second channel segment within another one of the upper sections, the second channel segment defining an outlet; and (iii) a third channel segment within the lower section, the third channel segment being more narrow than the first and second channel segments, the third channel segment winding along a path having at least one bend, the path extending substantially from the right closure segment to the left closure segment, the third channel segment configured to hold a carbon dioxide scrubbing material, a first part of the carbon dioxide scrubbing material being positionable adjacent to the right closure segment, a second part of the carbon dioxide scrubbing material being positionable adjacent to the left closure segment, a third part of the carbon dioxide scrubbing material being positionable between the right and left closure segments;

(G) a mouthpiece configured to receive breath from the person;

(H) at least one tube in fluid communication with the mouthpiece, the inlet and the outlet;

(I) a first valve positioned within the at least one tube, the first valve being configured to direct the breath toward the inlet; and (J) a second valve positioned within the at least one tube, the second valve being configured to direct at least part of the gas and at least part of the breath toward the mouthpiece after the part of the breath has flowed past the first, second and third parts of the carbon dioxide scrubbing material when the third channel segment is holding the carbon dioxide scrubbing material.

15. The rebreathing apparatus of claim 1, wherein: (a) the first channel segment defines a first reservoir free of internal dividers, the first reservoir configured to hold a volume of breath received from the person; and (b) the second channel segment defines a second reservoir free of internal dividers, the second reservoir configured to hold a volume of at least part of the gas and at least part of the breath after the part of the breath has flowed past the carbon dioxide scrubbing material, the first and second portions being positionable adjacent to a chest of the person when the person is wearing the clothing article.

16. The rebreathing apparatus of claim 15, which includes an additional layer positioned over the opposing layer.

17. The rebreathing apparatus of claim 1, wherein the carbon dioxide scrubbing material has a configuration selected from the group consisting of a belt configuration and a multi-layered belt configuration.

18. A rebreathing apparatus comprising:

a multilayer clothing article wearable on an upper body of a person, the person's upper body having a front, a plurality of sides, and a back, the person's front including a chest, the multilayer clothing article having:

(A) an inner layer spaced apart from an opposing layer, the inner layer configured to contact the person's upper body, the opposing layer being positioned opposite of the inner layer, the inner and opposing layers defining a breathing channel, the breathing channel configured to be in fluid communication with at least one container of gas;

(B) a perimeter edge extending along a perimeter of the multilayer clothing article, the perimeter edge including a right closure segment and a left closure segment, the perimeter edge defining a neck receiving opening when the right closure segment is in contact with the left closure segment;

(C) a plurality of arm receiving edges, including a right arm receiving edge and a left arm receiving edge, each one of the arm receiving edges defining an arm receiving opening configured to receive an arm of the person;

(D) a plurality of upper sections, including: (a) a right upper section positioned between part of the right arm receiving edge and the right closure segment; and (b) a left upper section positioned between part of the left arm receiving edge and the left closure segment;

(E) a lower section located below the upper sections, the lower section extending between the right and left closure edges, the lower section being positionable over the person's front, sides and back when the right closure segment is in contact with the left closure segment while the person is wearing the multilayer clothing article;

(F) a plurality of seals which seal the inner layer to the opposing layer, the seals including: (a) a first seal extending along the perimeter edge; (b) a second seal extending along the right arm receiving edge; (c) a third seal extending along the left arm receiving edge; and (d) a plurality of additional seals defining a plurality of internal seal lines, the internal seal lines defining a plurality of segments of the breathing channel, the segments including:

(i) a first channel segment within one of the upper sections, the first channel segment being positionable over part of the person's chest when the person is wearing the multilayer clothing article, the first channel segment defining a first counter-lung reservoir free of internal dividers, the first counter-lung reservoir defining an inlet;

(ii) a second channel segment within another one of the upper sections, the second channel segment being positionable over another part of the person's chest when the person is wearing the multilayer clothing article, the second channel segment defining a second counter-lung reservoir free of internal dividers, the second counter-lung reservoir defining an outlet; and (iii) a third channel segment within the lower section, the third channel segment being more narrow than the first and second channel segments, the third channel segment winding along a path having at least one bend, the path extending substantially from the right closure segment to the left closure segment, the third channel segment configured to hold a carbon dioxide scrubbing material distributed substantially entirely throughout the third channel segment;

(G) a mouthpiece configured to receive breath from the person;

(H) at least one tube in fluid communication with the mouthpiece, the inlet and the outlet;

(I) a first valve positioned within the tube, the first valve being configured to direct the breath toward the inlet; and (J) a second valve positioned within the tube, the second valve being configured to direct at least part of the gas and at least part of the breath toward the mouthpiece after the part of the breath has flowed past the carbon dioxide scrubbing material distributed substantially entirely throughout the third channel segment.

19. The rebreathing apparatus of claim 18, which includes an additional layer positioned over the opposing layer.

20. The rebreathing apparatus of claim 18, which includes the at least one container of gas, the gas including oxygen, the carbon dioxide scrubbing material having a belt configuration.

* * * * *